US005209488A

United States Patent [19]

Kimball

[11] Patent Number: 5,209,488

[45] Date of Patent: May 11, 1993

[54] THREE PLAYER CHESS-LIKE GAME

[76] Inventor: Mark R. Kimball, 407 N. Adair St., Clinton, S.C. 29325

[21] Appl. No.: 866,192

[22] Filed: Apr. 9, 1992

[51] Int. Cl.[5] ..... A63F 3/02

[52] U.S. Cl. ..... 273/261

[58] Field of Search ..... 273/242, 260, 261, 243, 273/275, 276, 283, 284, 287

[56] References Cited

U.S. PATENT DOCUMENTS

| | | | |
|---|---|---|---|
| 611,450 | 9/1898 | Gruver | 273/261 |
| 3,840,237 | 10/1974 | Shkolnik | 273/261 |
| 3,998,464 | 12/1976 | Poturalski | 273/261 |
| 4,653,759 | 3/1987 | Anderson et al. | 273/261 |

FOREIGN PATENT DOCUMENTS

| | | | |
|---|---|---|---|
| 2228465 | 1/1974 | Fed. Rep. of Germany | 273/261 |
| 0576271 | 6/1976 | Switzerland | 273/261 |
| 2028668 | 3/1980 | United Kingdom | 273/261 |
| 1597713 | 9/1981 | United Kingdom | 273/261 |
| 2214092 | 8/1989 | United Kingdom | 273/261 |

*Primary Examiner*—William Stoll

[57] ABSTRACT

A chess-like board game apparatus for three player chess is disclosed. The apparatus consists of a game board of such architecture so as to present to each of three players a portion of the overall board, which three portions consist of forty-eight playing positions each, arranged in eight file rows and six rank rows. The head of each of these segments is aligned with the external sides of an equal-sided triangular shaped board segment consisting of twenty-four positions. The game is played by three opponents, each employing a full complement of traditional chess pieces whose movements, although similar to what they would be in the conventional game of chess, are further governed by a set rules specific to the game apparatus.

7 Claims, 2 Drawing Sheets

THREE PLAYER CHESS-LIKE GAME

TECHNICAL FIELD OF THE INVENTION

The present invention appertains to a board game apparatus, and more particularly, to a chess-like board game apparatus.

BACKGROUND OF THE INVENTION

The game of chess is quite well known, having been enjoyed by countless persons down through the years since its inception. The game itself is played on a predominantly flat rectangular game board, the architecture having not significantly changed over the course of time. Likewise, the rules of traditional chess remain unchanged as well. Over the years, efforts have been made to modify the game so that it is either less complex or shorter in duration of play, or, supposedly more challenging, requiring even greater length of time to complete a single game. As player's personal tastes differ, the enthusiasm given to each variation likewise differs. What perhaps all the previous art fails to produce is a modification to chess that not only allows the introduction of more than two players into the game, but enhances the very nature of the game so dramatically as to produce what might be considered another generation of chess. The present invention solves the shortcomings of the previous art. Other objects and advantages of the present invention will be evident upon reference to the accompanying description.

DETAILED DESCRIPTION OF THE PRESENT INVENTION

Figure 1:
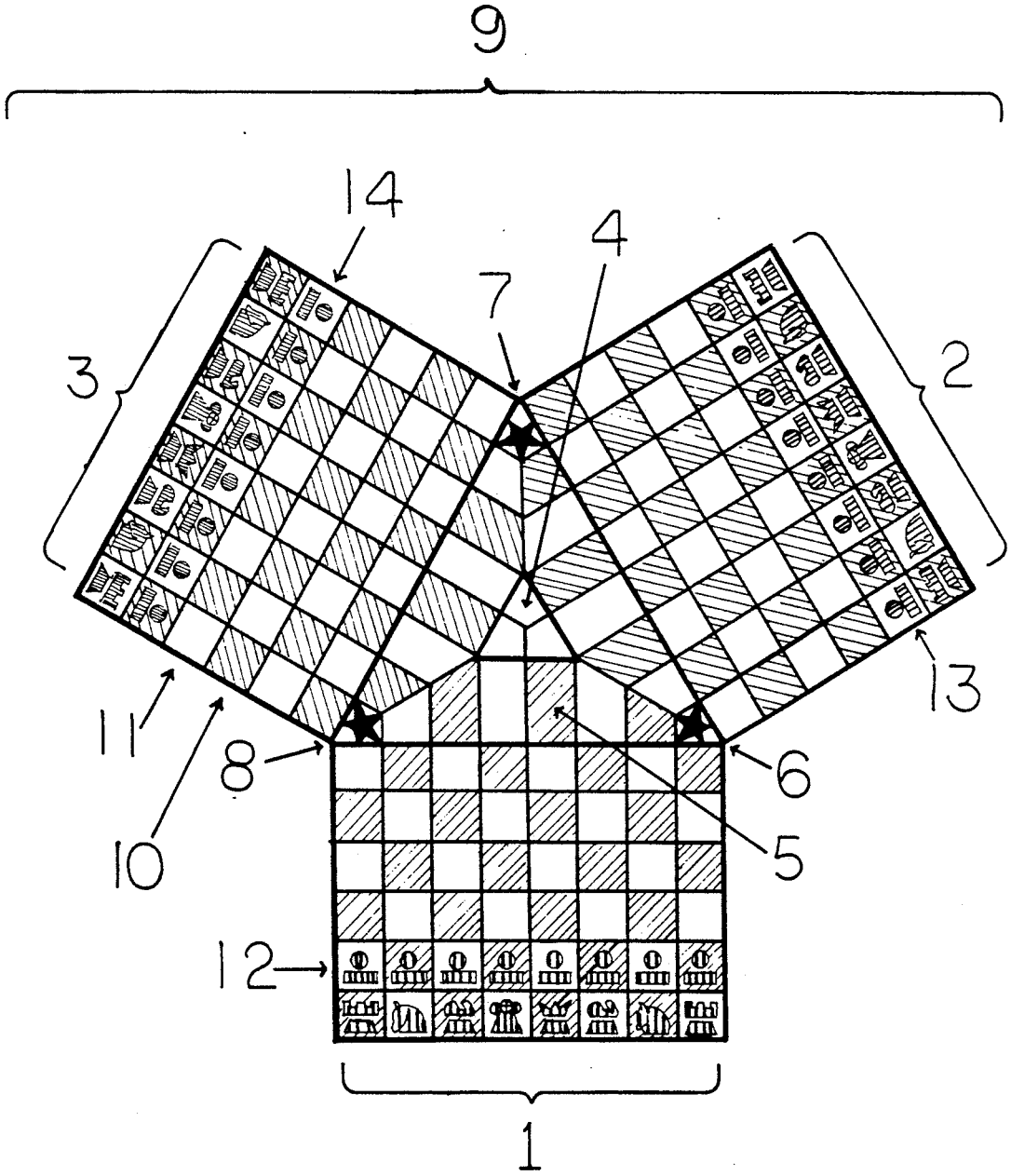
FIG. 1, shows a chess-like board game apparatus in accordance with the architecture of the present invention. The view is a top plan view of the board apparatus having three sets of chessman thereon according to the present invention, with the chessmen being indicated by conventional symbols and lined for different colors.

As may be seen in FIG. 1, the chess-like board apparatus is indicated generally at 9 and comprises alternating shaded squares 10 and clear squares 11 arranged to comprise a total of 48 squares for each of the three rectangular board areas represented by 1, 2, 3. These three segments of the overall board apparatus are joined and aligned with the external sides of a center, equal sided triangular portion of the board apparatus designated 5. This center triangle is made up of twenty-four positions; twenty-one of them being of either shaded or clear playing positions like as the shading pattern described for 10 and 11, and three positions, 6, 7, 8 which are marked by a Star pattern described on the board at each inside angle of the center triangle 5. Together, the number of positions on the entire board, 9, is 166 positions.

Positioned at the end of each of the rectangular portions of the board apparatus 1, 2, 3, are separate sets of chessmen. Each set of chessmen is conventional, and the individual pieces are positioned according to the rules of chess with the Pawns constituting a front row 12, 13, 14, and the other pieces placed in position according to the symbols conventionally used therefor. Each of the three sets of chess pieces is provided with a different color to differentiate between the three opposing players. The particular colors used are inconsequential but the colors should be contrasting and contribute to an overall pleasing appearance when considered together with the colors of the squares on the game board apparatus.

Each player controls a full set of chessmen with the three players positioning themselves at each end of the three rectangular protrusions of the board apparatus; 1, 2, 3. Each player comprises his or her own team and plays according to rules which are superimposed upon the conventional rules for chess.

Figure 2:
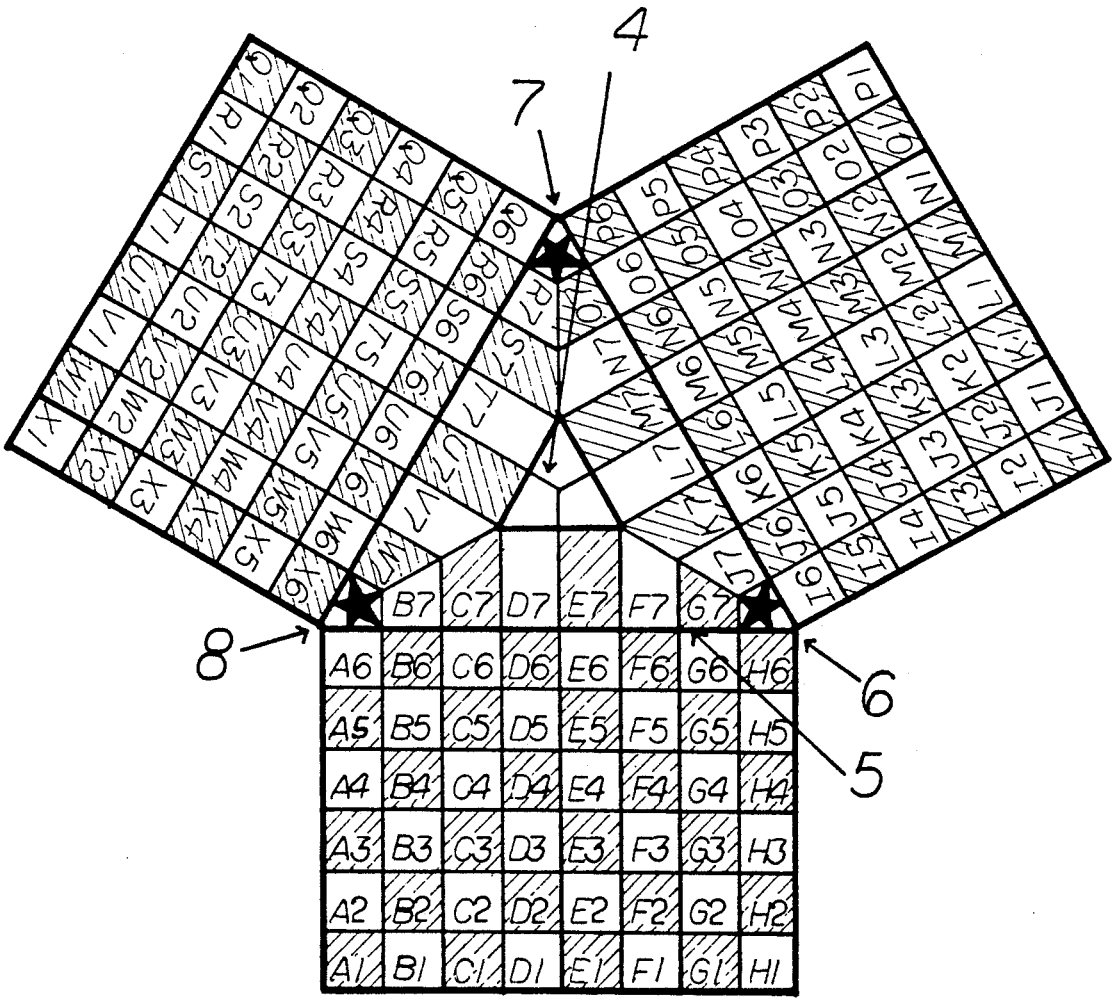
FIG. 2 is likewise a top plan view whereby the board apparatus is further inscribed with rank and file markings. Both figures employ a cross-hatching scheme to denote the checkerboard appearance of the playing positions.

In particular, these rules applying to the present invention are as follows:

Referring to FIG. 2, the movement of pieces about the playing surface of the game board apparatus is as follows:

The three Star positions (6, 7, 8) and the Inner Triangle (4) of the Great Triangle (5) *cannot* be occupied by any piece at any time. These positions serve as transfer points only. All pieces "slide" through these transfer points onto an opponents board, or, back onto a player's own board. A detailed explanation of how each piece moves through the transfer points is further described below. No two pieces can occupy the same square at the same time.

Pawns—The Pawn can move in one direction only—forward, one square at a time. However, if it is the first time a particular Pawn is being moved, the player has the option of moving the Pawn either one or two squares. In moving a Pawn, if the square directly in front of it is occupied, the Pawn is considered blocked and unable to move until the piece blocking its way is moved.

The Pawn is the only piece that does not capture in the same manner as it moves. The Pawn can capture any opposing piece which appears on the next square diagonally ahead—either to the left or right. As in the case of all captures, the captured piece is removed from the board and the captor moves to the square formerly held by the captured.

Keeping in mind that the Stars (6,7,8) and Inner Triangle (4) are only transfer points, the Pawn—in one move—"slides" through the transfer point onto the first square of the opposing board. All Pawns to the right of the center line (King's side of the board) will continue onto the opposing player's board to the right. Likewise, all Pawns to the left of the center line (Queens side of the board) will continue onto the opposing player's board to the left.

Example: Referring to FIG. 2, a Pawn at E7 would continue on its next move to L7 whereas D7 would travel to U7, and so on. Therefore, a capture would follow the same rule: all Pawns to the right of the center line can only capture into the board on the right. Likewise, all Pawns to the left of the center line can capture only into the board on the left.

Example: A Pawn at E7 could capture any piece occupying position K7. F7 could capture L7 or J7, G7 could capture only K7 and so on.

A Pawn *cannot* capture while transferring through a Star (6,7,8) or Inner Triangle (4).

Example: A Pawn at H6 cannot capture J7. The Pawn would have to first transfer into the next board (to position 16) where it would be in a position to capture a piece residing on J5 in a subsequent move.

Each Pawn that is moved to the first rank of any opposition board may be exchanged for a Queen, Rook, Bishop, or Knight of the same color without regard as to the number of such pieces presently on the board.

Bishops—The Bishop moves and captures diagonally in any direction over unoccupied squares.

There are three rules that govern the Bishop's travels from one board to the next:

1. The Stars (6,7,8)—If the Bishop is lined up with a Star (6,7,8) along a diagonal, he may continue through the Star (6,7,8) into the opposing board on the opposite color squares as those he now occupies.

Example: A Bishop at D3 may travel along the diagonal E4-F5-G6 to the Star (6), and continue onto the opposition board along the reverse color diagonal J6-K5-L4, etc.

2. The Inner Triangle (4)—If the Bishop is lined up with any of the six rectangles along rank 7 (D7, E7, L7, M7, T7, and U7) he may enter the Inner Triangle (4) and exit onto any position of the same color along the perimeter of the Inner Triangle (4).

Example: A Bishop at B5 can travel along C6-D7 into the Inner Triangle (4) and exit on either F7, L7, N7, T7, or V7. Likewise, a Bishop at G5 can travel along F6-E7 into the Inner Triangle (4) and exit on either K7, M7, S7, U7, or C7, and so on.

3. The Great Triangle (5)—The only remaining way for a Bishop to transfer onto an opposing player's board is by using one of the other twelve polygon positions along rank 7 that have not already been mentioned above. (B7, C7, F7, G7, and so on). When in alignment with one of these positions, the Bishop may pass through to the next board and stop on any position of the same color as the one he now occupies.

Example: A Bishop at E6 may travel along F7 and stop on either J7 or L7. Similarly, a Bishop at H6 may travel along a course of G7 stopping on K7. He cannot "slide" through the Star (6) onto I6.

Rooks—The Rook can move and capture in four directions, rank and file only (vertical and horizontal), over unoccupied squares. In similar fashion to the Pawn, the Rook to the right of the center line enters the opposing Player's board to the right, whereas the Rook to the left of the center line enters the opposition board to the left.

Example: A Rook at C3 may travel along the entire 3rd rank (A3-B3-C3-D3-E3-F3-G3-H3) and also along file C and V (C1-C2-C3-C4-C5-C6-C7-V7-V6-V5-V4-V3-V2-V1).

The Inner Triangle (4) has no effect on the Rook. A Rook at E7 would continue to L7 and a Rook at D7 would continue to U7. A Rook may capture at any time providing that no other piece comes between it and the captured.

The Rook, when lined up with a Star (6,7,8) can travel around the perimeter of the Great Triangle (5) and exit at any of the Stars (6,7,8) the player chooses—provided there are no other pieces blocking its path.

Example: A Rook at H3 can travel along file H to the Star (6) around rank 7 to any other Star (6,7,8) and may exit onto any file in line with that Star (file I, P, Q, X, A). Therefore, a Rook at H3 would be able to capture another piece at X3—provided there were no other pieces between them.

Queen—The Queen is the most powerful piece on the board for she possesses the combined power of both the Bishop and the Rook. She can move on the diagonal like the Bishop, and traverse the rank and file like the Rook.

All transfers through the Inner Triangle (4) adhere to the same rules as those provided for the Bishop and Rook. Therefore, if the Queen enters the Inner Triangle (4) as a Bishop, she must exit and stop on the first square of the same color on the opposing board as that color from whence board she came. (See "Examples" provided under "Bishops")

The Queen becomes very powerful, yet vulnerable, when lined up with a Star (6,7,8). Again, the same rules apply as to her movement as those given for Bishop and Rook—in with one very notable exception. When the Queen enters the Great Triangle (5) in line with a Star, she is allowed to exit out as either a Rook or a Bishop.

Example: A Queen at D3 is lined up diagonally with the Star (6). (D3-E4-F5-G6, to the Star). From this position the Queen, provided there are no other pieces in her path, can travel along rank 7 to any of the Stars (6,7,8) and exit into any file the player chooses (File H, I, P, Q, X, A). The Queen may also exit any of the diagonals from a Star (J6, K5, L4, M3, etc; O6, N5, M4, L3, etc; R6, S5, T4, U3, etc; W6, V5, U4, T3, etc; B6, C5, D4, E3, etc).

Knights—The Knight controls up to eight squares at any given point in time. The Knight's move is similar to the shape of the letter "L": two squares along the vertical, and one along the horizontal, or, two along the horizontal and one along the vertical. In other words, the Knight moves and captures in any direction by a movement combining the moves of the Bishop and the Rook, that is, it moves one square, which final square must not adjoin the square from which the Knight first moved. This configuration of movement causes the color of the square upon which the Knight rests to be changed with each successive move.

Example: From D3, the Knight is able to move to either E1, F2, F4, E5, C5, B4, B2, or C1.

The Inner Triangle (4) can not be used by the Knight at any time. However, the Knight can "slide" through a Star (6,7,8) and onto an opposition board.

Example: The Knight at H6 would "slide" through the Star (6) to I6, I5, and over to J5, or, from H6 through the Star (6) to I6 and over two squares to K6. From H6 the Knight would also be able to move to squares G4, F5, F7, and J5). A Knight on F7 would be able to move to squares H6, G5, E5, D6, J6, L6 and M7.

King—The King is the most important piece on the board; as the object of the game is to capture your opponents' King. The player with the last King left on the board is the winner and the game is over.

The King can be moved to any square adjoining the square he occupies and captures in like fashion any unprotected opposing piece. (The King cannot capture another piece if in so doing he is moving into "Check". See Check and Checkmate below).

The King can not use the Stars (6,7,8) or Inner Triangle (4) at any time. Any transfer into an opposition board must be made without the use of these areas.

Castling—Once during the game, each player is allowed to perform a move known as Castling. Castling is where the King is moved two squares either to his right or left, and the Rook toward which the King has moved is placed on the square on the far side of the King. Castling is further subject to the following:

1. Neither the King nor the Rook to be used has been moved previously during the game.

2. There are no pieces occupying the squares between the King and the Rook to be used.
3. The King is not in "Check" at the time a player is Castling.
4. No opponents piece controls either of the squares next to the King in the direction of the Rook. (Thus the King will not pass through, or into, "Check".)

Example: King at E1 and Rook to be used is at H1. Rook would move to position F1 and the King would "jump over", or Castle, to G1. Likewise, a King at E1, employing the Rook at A1 would find the Rook moving to D1 and the King would Castle to the square at C1.

Castling is a single move and its purpose is to place the King in a position of greater safety and bring the Rook into a position where it can become more active.

Check—The King is in Check when he is attacked by an opponents piece. (On the next move, an opponent can capture another player's King.) The player making Check must announce aloud "Check". One of three courses of action must be done by the player who owns the King in Check:

1. The King must move out of Check.
2. The hostile piece that places the King in Check must itself be captured.
3. A piece must be placed between the King and the attacking piece, thus cancelling out the Check.

Unless a player is able to free his King from Check in one of these three ways, the Check turns into "Checkmate".

Checkmate—This means that the King is "dead" and the player possessing that King is out of the game and all of his remaining pieces pass into the possession of his captor. Play continues until there is but one King remaining. (Note: If player #1 is placed in Check by player #2, and player #2 is in turn placed in Check by player #3, then player #1 is no longer in Check as player #2 is not free to capture his King until he, himself, is first free from Check.) The object of the game is to be the last player possessing a viable King—one who is free from the Checkmate condition.

Two-Player Variation—The game can be played with only two players by removing all the pieces normally assigned to a third player. The game is over when Checkmate is made.

Thus it can be seen that the present invention has disclosed a three player chess-like game apparatus which is played based in large part on the conventional rules of chess but which affords much more entertainment and challenge through the unique opportunities in strategy afforded by the invention. The element of skill is greatly enhanced and the introduction of a third player heightens the overall excitement of the game. Since the rules for the present invention are based in large measure on the conventional rules of chess, the time needed to learn the invention is modest.

It will be understood that this invention is susceptible to modification in order to adapt it to various usages and conditions, and therefore, it is desired to comprehend such modifications within this invention as may fall within the scope of the appended claims.

What is claimed is:

1. A board game apparatus for a three player chess game which comprises:

a central flat board member having three sides which define an equilateral triangle, said central flat board member being divided into a plurality of geometric playing positions including:

i) a central equilateral triangle having three sides which are parallel to and evenly spaced apart from the sides of the central flat board member, said central equilateral triangle being further divided into three playing positions by converging lines which are perpendicular to and bisect each of said three sides of said central equilateral triangle; and ii) a peripheral playing area defined between the three sides of said central equilateral triangle and the three sides of said central flat board member, said peripheral playing area being divided into a plurality of playing positions each of which consists of a four-sided polygon; and three flat rectangular shaped board members each being aligned with and adjoining one of said three sides of said central flat board member, each of said three flat rectangular shaped board members being divided into a plurality of substantially square playing positions which are aligned in perpendicular rank and file rows and define a checkerboard pattern.

2. A board game apparatus for a three player chess game according to claim 1, wherein said central flat board member is divided into twenty-four playing positions.

3. A board game apparatus for a three player chess game according to claim 1, wherein said plurality of playing positions into which said peripheral playing area is divided includes rectangles, trapezoids and trapeziums.

4. A board game apparatus for a three player chess game according to claim 3, wherein said peripheral playing area includes six rectangular playing positions.

5. A board game apparatus for a three player game according to claim 1, wherein each of said three flat rectangular shaped board members is divided into forth-eight playing positions.

6. A board game apparatus for a three player chess game according to claim 1 further comprising three sets of playing pieces.

7. The combination of claim 6, wherein each of said three sets of playing pieces is of a different color.

* * * * *